United States Patent [19]

Ellingson, Jr.

[11] Patent Number: 4,663,903

[45] Date of Patent: May 12, 1987

[54] FLOOR COVERING STRUCTURE

[75] Inventor: Chester W. Ellingson, Jr., Burnsville, Minn.

[73] Assignee: Reese Enterprises, Inc., Minneapolis, Minn.

[21] Appl. No.: 879,350

[22] Filed: Jun. 27, 1986

[51] Int. Cl.[4] ..... E04F 11/16; B32B 23/02

[52] U.S. Cl. ..... 52/181; 52/71; 52/177; 428/52; 428/58; 428/192; 15/215

[58] Field of Search ..... 15/215–217, 15/238, 239; 52/71, 177, 181, 593; 404/19, 35, 41; 428/52, 57, 58, 62, 192

[56] References Cited

U.S. PATENT DOCUMENTS

| | | | |
|---|---|---|---|
| Re. 32,061 | 1/1986 | Ellingson, Jr. | 428/52 |
| 2,181,812 | 11/1939 | Kammerer | 428/58 X |
| 3,435,480 | 4/1969 | Mann, Jr. | 15/215 |
| 3,477,763 | 11/1969 | Greichgauer | 300/21 |
| 4,029,834 | 6/1977 | Bartlett | 428/62 |
| 4,568,587 | 2/1986 | Balzer | 428/52 |

FOREIGN PATENT DOCUMENTS

| | | | |
|---|---|---|---|
| 2135372A | 8/1984 | United Kingdom | 52/204 |

*Primary Examiner*—John E. Murtagh
*Assistant Examiner*—Andrew Joseph Rudy
*Attorney, Agent, or Firm*—Leo Gregory

[57] ABSTRACT

A floor covering for public areas such as foyers in public buildings, each section of the floor covering being substantially rectangular in plan of a fairly narrow width, having a flexible projecting tongue along one side thereof, said tongue extending to underlie at least a portion of said sections and having the other side thereof adapted to receive and non-rotatively retain the projected tongue of an adjacent such section whereby like sections interconnect to form a floor covering, the tongues being sufficiently flexible to permit the connected sections to be rolled up.

3 Claims, 3 Drawing Figures

FLOOR COVERING STRUCTURE

BACKGROUND OF THE INVENTION

1. Field of Invention.

This invention relates to floor covering sections for public indoor walking areas.

2. Description of the Prior Art.

It is a common practice to have removable floor coverings for public indoor walking areas such as in the entry ways to public buildings. Such floor coverings are generally arranged to be rolled up for cleaning purposes.

A prior art structure is disclosed in U.S. Letters Pat. No. 4,029,834 to G.F. Bartlett issued June 14, 1977. Here what are described as rails form portions of a mat, the same being rotatably interconnected by rigid projected edge portions.

Another prior art structure in U.S. Letters Pat. No. 4,568,587 issued Feb. 4, 1986 to C.P. Balzer discloses rigid rails interconnected by flexible hinge members which bend longitudinally to allow the rails to be rolled up.

In a U.S. Letters Pat. Re. 32,061 issued January 7, 1986 to Chester W. Ellingson, Jr. is disclosed the use of rigid coupling members having rotatable interengagement with adjacent floor covering sections permitting a roll-up of the floor sections for cleaning purposes.

SUMMARY OF THE INVENTION

This invention relates to an indoor floor covering or matting for public walk areas, the floor covering consisting of interconnected like sections, each having a suitable walking surface and being connected to permit a roll-up of sections for cleaning purposes.

More particularly it is an object of this invention to provide a floor covering consisting of rectangular sections of like structure, each section having a side edge portion formed as a receptacle and a side edge portion formed as an extended connecting web, said web portion providing underlying support for said section and being sufficiently flexible to form a living hinge in bending along a longitudinal axis for a roll up of connected of said sections.

It is a further object of this invention to provide a floor covering for use in public walking areas such as foyers in office buildings, the floor covering consisting of like rectangular sections of rigid material, each having a flexible edge portion extruded therewith projecting to have a nonrotatable interengagement with the facing edge portion of an adjacent section, said edge projection forming a living hinge by bending along a longitudinal axis thereof to provide for a roll up of connected sections, said projecting edge portion extending rearwardly forming underlying bottom support for said section.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
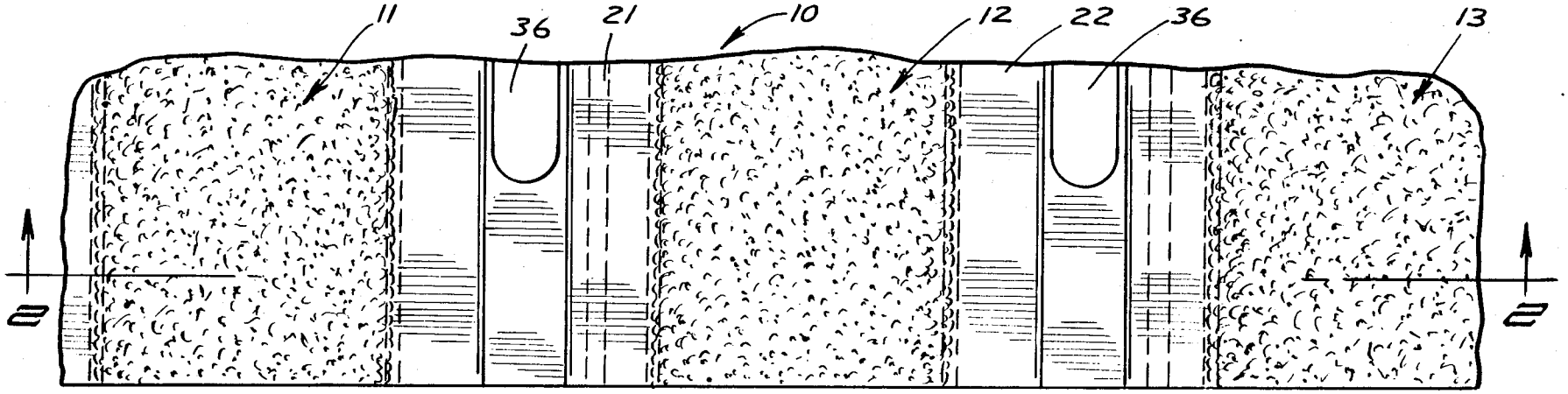
FIG. 1 is a broken top plan view.
Figure 2:
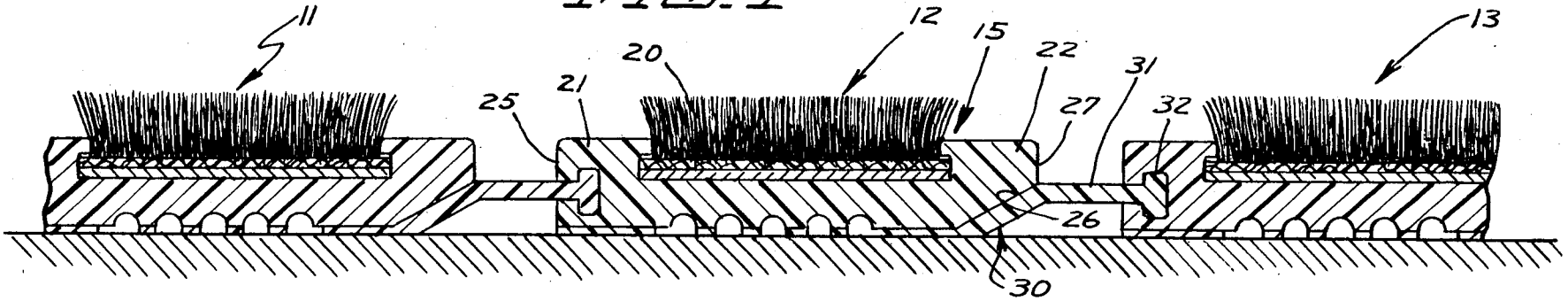
FIG. 2 is a view in vertical section taken on line 2—2 of FIG. 1 as indicated.

Referring to the drawings, a mat or floor covering structure 10 is shown in FIG. 1 made up of interconnected closely spaced like sections as indicated at 11, 12 and 13 in FIG. 2. The section 12 will be described as representative of all sections and like reference numerals will indicate like parts of the several sections.

The structure herein to be described is particularly adapted to be laid upon the top of a floor surface rather than being installed within a recessed floor area as is the case with some floor coverings.

Figure 3:
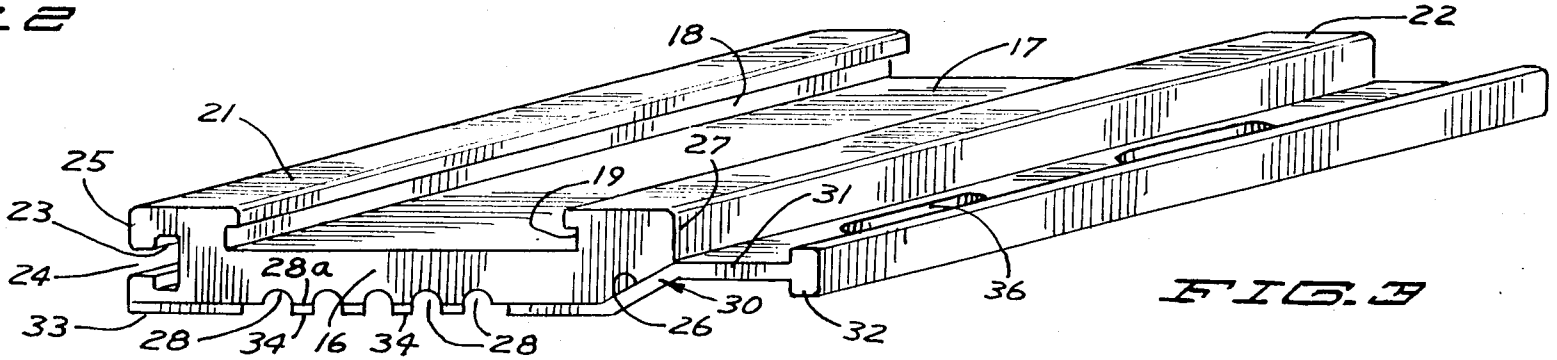
FIG. 3 is a view in perspective.

With particular reference to FIGS. 2 and 3, said section 12 is formed preferably as an extrusion of a dual durometer plastic material. The main body portion 15 of said section is desirably formed of a rigid plastic material such as of the B.F. Goodrich Company polymer composite known in the trade by the mark FIBERLOC. This material is designed to provide high strength and stiffness, excellent dimensional stability, high resistance to wear and deterioration and low thermal expansion.

The interconnecting portion 30 of said section is preferably formed of a flexible PVC material which bends readily along a longitudinal axis as a living hinge permitting a roll up of interconnected sections for cleaning purposes.

The main upper body portion 15 comprises a central longitudinal recess 17 having opposed facing grooves 18 and 19 receiving a tread strip 20 for walking surface and said strip may be formed of a suitable carpeting material.

Each side edge portion of said main body portion 15 is substantially rectangular in cross section forming shoulders 21 and 22. Said shoulder 21 has a non-circular longitudinal bore 23 therein having an open slot 24 through its outer side 25.

Said shoulder 22 is formed having the lower edge portion 26 beveled rearwardly from approximately the midpoint of its outer wall 27.

A plurality of longitudinal grooves 28, here shown as being semicircular in cross section, are formed in the bottom portion 16 of said section. The grooves permit the saving of material.

Extruded integrally with said member 12, underlying and extending outwardly of said shoulder 22 and also underlying an adjacent portion of the bottom 16 is a strip 30 which forms a living hinge. Said strip, as shown, projects a web portion 31 terminating in an enlarged terminal portion 32 having a cross sectional configuration to be nonrotatably received within the bore 23 of an adjacent section whereby the several sections of a floor covering are interconnected. As above indicated, said strip 30 is preferably formed of a flexible PVC material. Said slot 24 has a height just sufficient to accomodate said web 31.

A strip 33 of PVC material is also extruded with said main body portion 15 to underlie and support the edge portion of said bottom 16 remote from said strip 30 and also narrow PVC supporting strips 34 are extruded simultaneously to underlie at least some of the spaces **28*a* between the grooves 28**.

Thus the main body portion of the member 12 is formed of a rigid plastic material and a separate edge strip of material of a different durometer is extrude therewith to form a living hinge and provide bottom support.

The web portion 31 of said strip 30 has spaced drain holes 36 therein.

Although not here shown, it is contemplated that upon installation of the floor covering structure herein described, a perimeter beveled edging will be applied.

As is seen from the description given, sections of the floor covering structure described are readily assembled. The PVC material provides a quiet resilient supporting base and the connecting hinges are noisless when walked upon eliminating the presence of sound from any relative movement of interconnecting parts.

The beveled end wall 26 taken with the flexible web 31 provides a relative and compact roll up of the several sections for cleaning purposes.

It will of course be understood that various changes may be made in form, details, arrangement and proportions of the parts without departing from the scope of the invention herein which, generally stated, consists in an apparatus capable of carrying out the objects set forth, in the parts and combination of parts disclosed and defined in the appended claims.

What is claimed is:

1. A floor covering structure consisting of interconnected sectionns, having in combination floor covering sections, a main body portion of one of said sections having a top portion, a bottom portion, and a shoulder at each side thereof, each of said shoulders having an outer side wall, one of said shoulders having a longitudinal bore therethrough, said bore being non-circular in cross section, a slot from said bore extending outwardly of said outer side wall of said one of said shoulders, a flexible strip of material integral with said main body portion underlying said other one of said shoulders and said bottom portion, an outward extension of said strip forming a web and having an enlarged terminal portion having a cross sectional configuration compatible with that of said bore, said terminal portion being disposed into the bore of said one of said shoulders of a main body portion of an adjacent section and being non-rotatable therein.

said web of said extension of said strip separating said last mentioned shoulder and said other one of said shoulders, whereby said sections may be rolled up along a longitudinal axis of said web.

2. The structure of claim 1, wherein said other of said shoulders has a lower edge portion of its outer side wall slanted rearwardly downwardly to be undercut to make more compact a roll-up of said sections.

3. The structure of claim 1, wherein said other of said shoulders has a beveled undercut edge portion to make more compact a roll up of said sections.

* * * * *